US005595155A

United States Patent [19]

Poch et al.

[11] Patent Number: 5,595,155

[45] Date of Patent: Jan. 21, 1997

[54] ROTARY INTERNAL COMBUSTION ENGINE

[76] Inventors: Poeut Poch, 1044 Olive Ave.; Vorng Pouv, 1134 Gardenia Ave.; Tan Vannak, 1712 Gardenia Ave., all of Long Beach, Calif. 90813; Chhim Bophan, 651 Canterbury Cir., Corona, Calif. 91719

[21] Appl. No.: 385,592

[22] Filed: Feb. 8, 1995

[51] Int. Cl.[6] ..... F02B 53/00

[52] U.S. Cl. ..... 123/240

[58] Field of Search ..... 123/240

[56] References Cited

U.S. PATENT DOCUMENTS

| | | | |
|---|---|---|---|
| 1,839,638 | 1/1932 | Beals et al. | 123/240 |
| 2,289,342 | 7/1942 | Canfield | 123/240 |
| 3,942,484 | 3/1976 | Pile | 123/240 |

FOREIGN PATENT DOCUMENTS

| | | | |
|---|---|---|---|
| 648568 | 1/1951 | United Kingdom | 123/240 |

*Primary Examiner*—Michael Koczo

[57] ABSTRACT

A rotary internal combustion engine including a rotatable blade driver mechanism including a shaft, a cam coupled about the shaft, a plurality of annular blade drivers coupled to the shaft, and a plurality of extendable compression blades slidably disposed through the blade drivers; and a casing generally encompassing the blade driver mechanism, the casing including a plurality of concentric side walls projected therefrom to create an annular compression chamber and an annular combustion chamber and further including a plurality of annular blade guides extended therefrom and with the blade guides slidably secured to the compression blades and the combustion blades for controlling their extension within the compression chambers and combustion chambers when the driver mechanism rotates.

7 Claims, 8 Drawing Sheets

ROTARY INTERNAL COMBUSTION ENGINE

BACKGROUND OF THE INVENTION

1. Field of the Invention

The present invention relates to a rotary internal combustion engine and more particularly pertains to delivering rotational torquing power for subsequent use with a rotary internal combustion engine.

2. Description of the Prior Art

The use of rotary engines is known in the prior art. More specifically, rotary engines heretofore devised and utilized for the purpose of delivering rotational torquing power are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,120,620 to Campos et al. discloses a rotary internal combustion engine. U.S. Pat. No. 5,203,307 to Burtis discloses a rotary Wankel-type engine. U.S. Pat. No. 5,271,364 to Snyder discloses a rotary internal combustion engine. U.S. Pat. No. 5,301,637 to Blount discloses a rotary-reciprocal combustion engine. U.S. Pat. No. 5,309,716 to Kolbinger discloses a rotary pump or engine with spherical body.

While these devices fulfill their respective, particular objective and requirements, the aforementioned patents do not describe a rotary internal combustion engine that allows continuous revolving motion with minimal component wear and allows a high compression ratio to be achieved.

In this respect, the rotary internal combustion engine according to the present invention substantially departs from the conventional concepts and designs of the prior art, and in doing so provides an apparatus primarily developed for the purpose of delivering rotational torquing power for subsequent use.

Therefore, it can be appreciated that there exists a continuing need for new and improved rotary internal combustion engine which can be used for delivering rotational torquing power for subsequent use. In this regard, the present invention substantially fulfills this need.

SUMMARY OF THE INVENTION

In the view of the foregoing disadvantages inherent in the known types of rotary engines now present in the prior art, the present invention provides an improved rotary internal combustion engine. As such, the general purpose of the present invention, which will be described subsequently in greater detail, is to provide a new and improved rotary internal combustion engine and method which has all the advantages of the prior art and none of the disadvantages.

To attain this, the present invention essentially comprises, in combination, a rotatable blade driver mechanism including a cylindrical shaft, a dual cam coupled about the shaft, and a pair of generally annular blade drivers coupled to the shaft on each side of the dual cam. Each blade driver has an inboard surface, an outboard surface, a circular inner extent, and an annular outer extent planarly outwardly offset from the inner extent. The outer extent of each blade driver further includes an inboard blade slot disposed therethrough, an outboard blade slot disposed therethrough and angularly offset from the inboard blade slot, and a plurality of elongated tubular circumferentially positioned air vent holes formed radially therethrough between an inner edge extent and an outer edge extent thereof. Each blade driver further has an elongated compression blade slidably disposed within the outboard blade slot and an elongated combustion blade slidably disposed within the inboard blade slot. Each blade driver additionally has a hollow complimentary compression balancing casing coupled to the inboard surface with an elongated compression blade balancing mass slidably disposed therein and a hollow complimentary combustion balancing casing coupled to the inboard surface with an elongated combustion blade balancing mass slidably disposed therein. The compression blade balancing mass of one of the blade drivers is positioned in general axial alignment with the compression blade of the other blade driver. The combustion blade balancing mass of one of the blade drivers is positioned in general axial alignment with the combustion blade of the other blade driver.

A generally tubular casing is included and generally encompasses the blade driver mechanism such that the shaft is projected outwards therefrom. The casing includes a pair of outer casing sections with a mid-casing section therebetween. Each outer casing section includes a tubular bearing housing disposed about the shaft of the driver mechanism for allowing its axial rotation, an annular face plate coupled to and extended radially outwards from the bearing housing and with the face plate having an inboard surface, an outboard surface, and three integral concentric side walls projected inwards from the inboard surface thereof to create an annular inner air chamber, an annular outer compression chamber, and an annular intermediate combustion chamber therebetween. Each outer casing section further includes a combustion chamber blocker extended radially across the combustion chamber and secured between the adjacent side walls, a compression chamber blocker extended radially across the compression chamber and secured between the adjacent side walls, a plurality of circularly positioned air vent holes disposed through the face plate and placed in communication with the inner air chamber, an air inlet port disposed through the face plate and placed in communication with the compression chamber on one side of the compression chamber blocker, a compressed air outlet port disposed through the face plate and placed in communication with the compression chamber on another side of the compression chamber blocker, a spark plug port disposed through the face plate and placed in communication with the combustion chamber on one side of the combustion chamber blocker, an air-fuel intake port disposed through the face plate and placed in communication with the combustion chamber between the spark plug port and the combustion chamber blocker, and an exhaust port disposed through the face plate and placed in communication with the combustion chamber on another side of the combustion chamber blocker. Each outer casing section is positioned in facing contact with the outer extent of the outboard surface of one of the blade drivers to thereby seal the respective inner air chamber, combustion chamber, and compression chamber and place the corresponding compression blade into the compression chamber and the corresponding combustion blade into the combustion chamber. The positioning of the outer casing sections in association with the mid-casing section creates a central oil sump. The mid-casing section has a generally tubular outer extent and an annular blade guide assembly extended radially inwards. The blade guide assembly has an upper portion with a pair of push rod bores disposed therethrough and an outer radial pair and an inner radial pair of annular blade guides extended therefrom. The outer pair of blade guides is slidably secured to the compression blades of the blade drivers and the compression blade balancing masses of the other blade driver for controlling extension of the compression blades when being revolved within the compression chambers. The inner pair of blade guides is slidably secured to the combustion blades of the blade drivers and the combustion blade balancing masses of the other blade driver for controlling extension of the combustion blades when being revolved within the combustion chambers.

Lastly, a rocker arm mechanism is included and secured to an upper extent of the casing. The rocker arm mechanism includes a pair of hollow valve housings. Each valve housing is secured to the outboard surface of each face plate of the casing and further placed in communication with the corresponding compressed air output port and the corresponding air-fuel intake input port. Each valve housing further includes a fuel inlet disposed thereon and a spring-loaded valve slidably disposed therein and with each valve having a head portion and a body portion with a fuel atomizer tip secured thereto. The body portion is positionable for allowing selective communication between the air-fuel intake port, the compressed air output port, and the fuel inlet port and further allowing alignment of the fuel atomizer with the fuel inlet. The rocker arm mechanism further includes a pair of elongated push rods separately slidably disposed within the push rod bores of the casing and positioned in contact with the dual cam. The rocker arm mechanism additionally includes a pair of rockers coupled to the upper extent of the casing and with each rocker having an arm extended between and in contact with the head portion of one of the valves and an upper end of one of the push rods and with rotation of the dual cam selectively actuating the rockers for allowing the associated ports to be opened and closed by the valve.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rotary internal combustion engine which has all the advantages of the prior art rotary engines and none of the disadvantages.

It is another object of the present invention to provide a new and improved rotary internal combustion engine which may be easily and efficiently manufactured and marketed.

It is a further object of the present invention to provide a new and improved rotary internal combustion engine which is of durable and reliable construction.

An even further object of the present invention is to provide a new and improved rotary internal combustion engine which is susceptible of a low cost of manufacture with regard to both materials and labor, and which accordingly is then susceptible of low prices of sale to the consuming public, thereby making such a rotary internal combustion engine economically available to the buying public.

Still yet another object of the present invention is to provide a new and improved rotary internal combustion engine which provides in the apparatuses and methods of the prior art some of the advantages thereof, while simultaneously overcoming some of the disadvantages normally associated therewith.

Even still another object of the present invention is to provide a new and improved rotary internal combustion engine for delivering rotational torquing power for subsequent use.

Lastly, it is an object of the present invention to provide a new and improved rotary internal combustion engine comprising a rotatable blade driver mechanism including a shaft, a cam coupled about the shaft, and a plurality of annular blade drivers coupled to the shaft, and a plurality of extendable compression blades slidably disposed through the blade drivers; and a casing generally encompassing the blade driver mechanism such that the shaft is projected outwards therefrom, the casing including a pair of outer casing sections with a mid-casing section therebetween, each outer casing section including a plurality of concentric side walls projected therefrom to create a generally annular compression chamber and a generally annular combustion chamber, each outer casing section further including a combustion chamber blocker extended across the combustion chamber, a compression chamber blocker extended across the compression, an air inlet port disposed through the face plate and placed in communication with the compression chamber on one side of the compression chamber blocker, a compressed air outlet port disposed through the face plate and placed in communication with the compression chamber on another side of the compression chamber blocker, a spark plug port disposed through the face plate and placed in communication with the combustion chamber on one side of the combustion chamber blocker, an air-fuel intake port disposed through the face plate and placed in communication with the combustion chamber between the spark plug port and the combustion chamber blocker, and an exhaust port disposed through the face plate and placed in communication with the combustion chamber on another side of the combustion chamber blocker, each outer casing section positioned in facing contact with one of the blade drivers to thereby seal the respective combustion chamber and compression chamber and further place the corresponding compression blade into the compression chamber and the corresponding combustion blade into the combustion chamber, the mid-casing section having an annular blade guide assembly extended radially inwards with a plurality of annular blade guides extended therefrom and with the blade guides slidably secured to the compression blades and the combustion blades for controlling their extension within the compression chambers and combustion chambers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
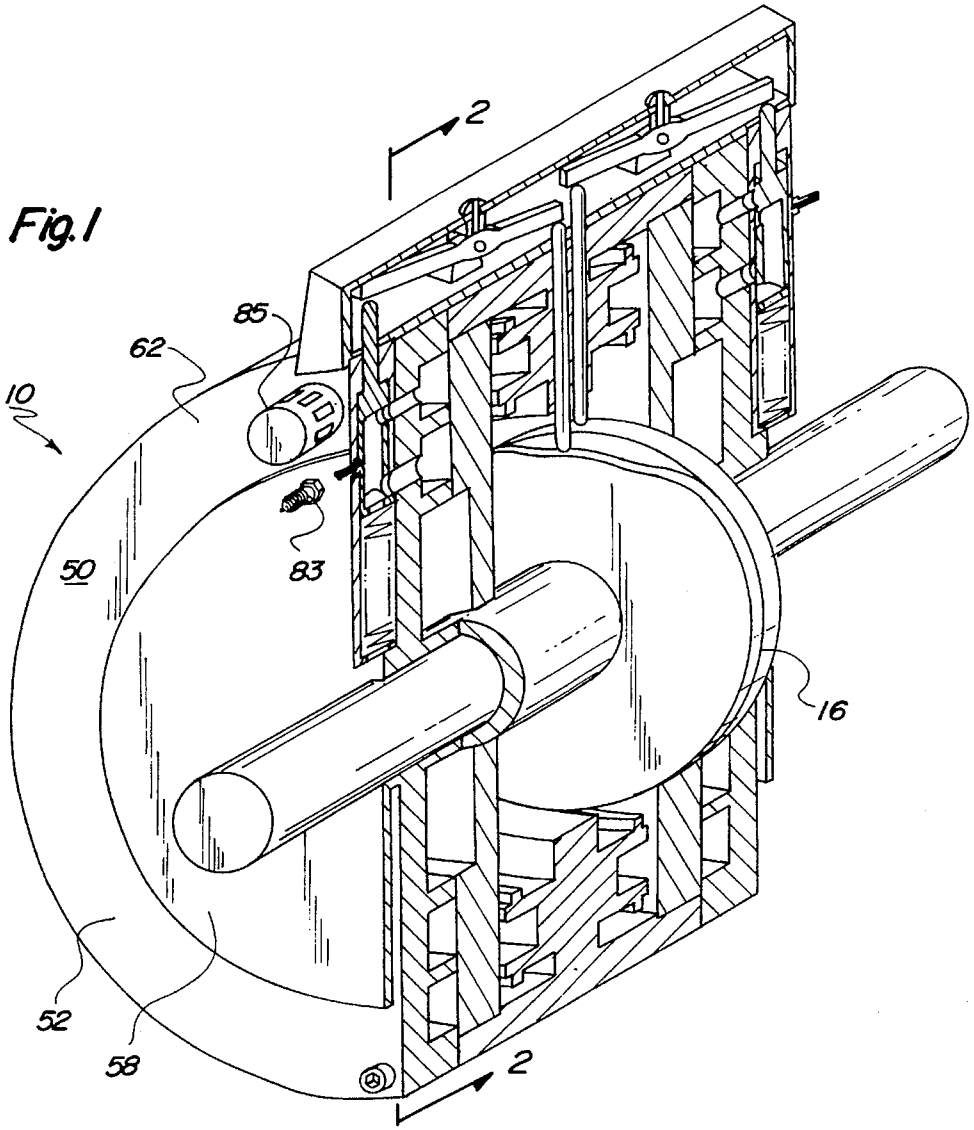
FIG. 1 is a cross-sectional view of the preferred embodiment of the present invention.

With reference now to the drawings, and in particular, to FIG. 1 thereof, the preferred embodiment of the new and improved rotary internal combustion engine embodying the principles and concepts of the present invention and generally designated by the reference number 10 will be described.

The present invention is comprised of a plurality of components. In their broadest context, such components include a blade driver mechanism, a casing, and a rocker arm mechanism. Such components are individually configured and correlated with respect to each other to provide the intended function of providing rotational torquing power for use.

Figure 4:
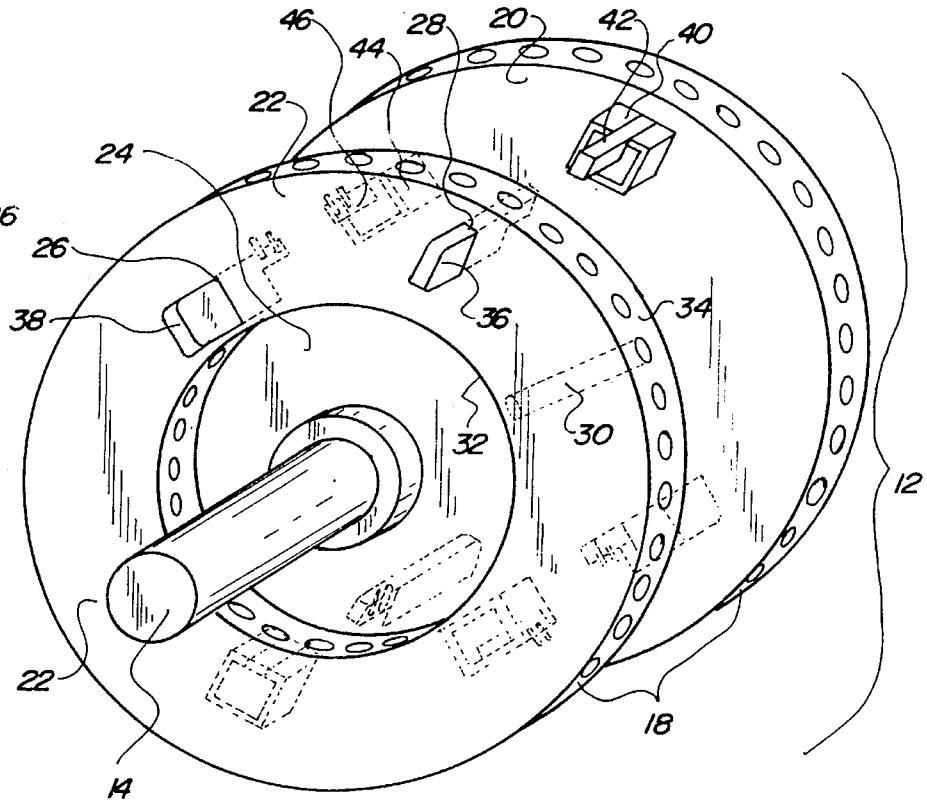
FIG. 4 is a perspective view of the blade driver mechanism of the present invention.
Figure 5:
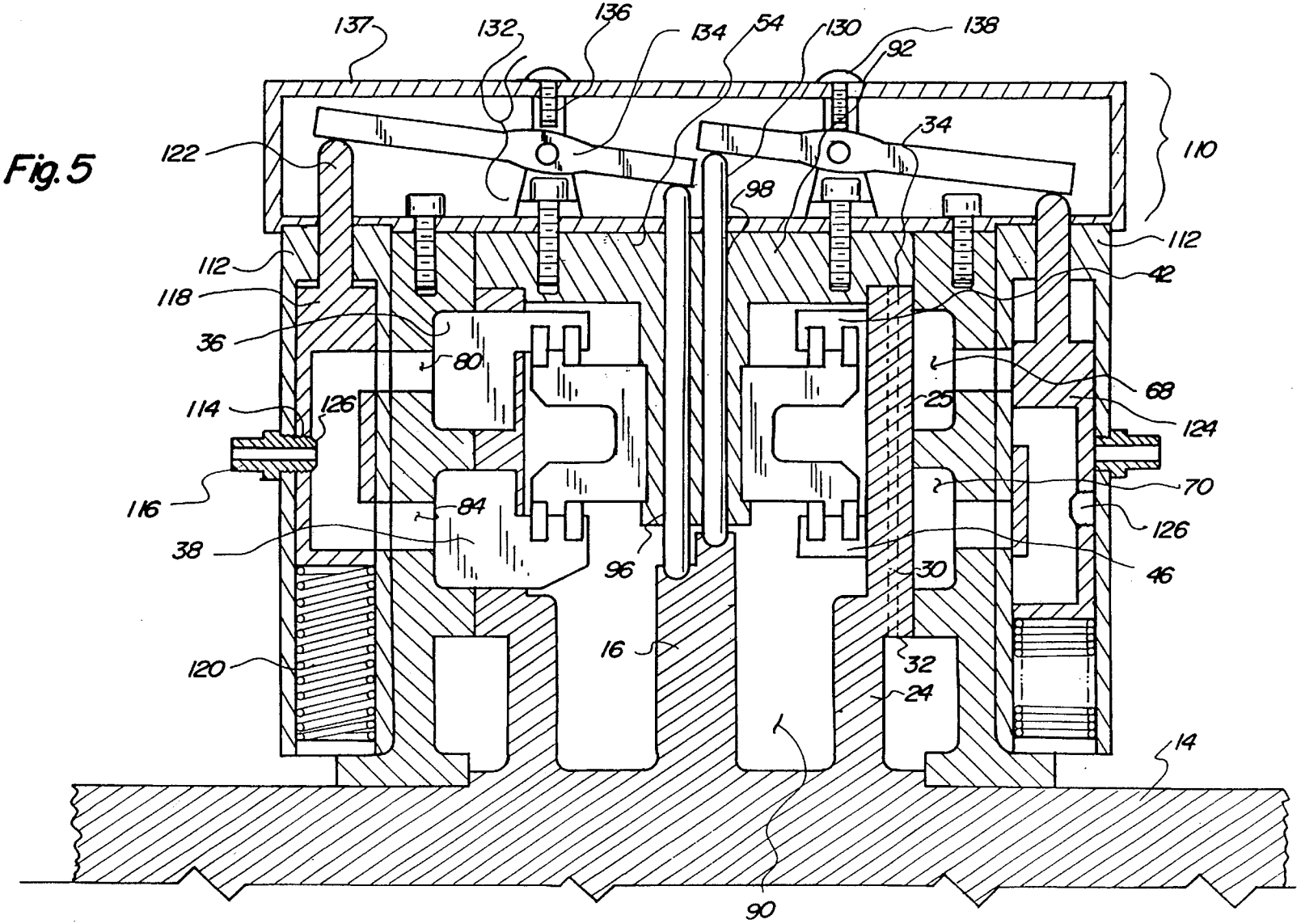
FIG. 5 is a cross-sectional view of an upper portion of the present invention.

Specifically, the present invention includes a rotatable blade driver mechanism 12 as shown in FIG. 4. The blade driver mechanism includes a cylindrical shaft 14 with two free ends, a dual cam 16 coupled about a central portion of the shaft, and a pair of generally annular planar blade drivers 18 coupled to the shaft on each side of the dual cam 16. Each blade driver has an inboard surface 20, an outboard surface 22, a circular inner extent 24, and an integral annular outer extent 25 planarly and outwardly offset from the inner extent as shown in FIG. 5. Furthermore, as shown in FIG. 4, the outer extent 25 further includes an inboard blade slot 26 disposed therethrough and an outboard blade slot 28 disposed therethrough. The outboard blade slot 28 is positioned radially outwards and angularly offset from the inboard blade slot 26. In addition, each blade driver includes a plurality of elongated and tubular circumferentially positioned air vent holes 30 formed radially therethrough between an inner edge extent 32 and an outer edge extent 34 thereof as best illustrated in FIG. 5. Again referring to FIG. 4, each blade driver further has an elongated compression blade 36 slidably disposed within the blade slot 28. Also included is an elongated combustion blade 38 slidably disposed within the inboard blade slot 26. Each blade driver also has a hollow complimentary compression balancing casing 40 coupled to the inboard surface 20. An elongated compression blade balancing mass 42 is slidably disposed within the casing 40. In addition, a complimentary combustion balancing casing 44 is coupled to the inboard surface 20 and includes an elongated combustion blade balancing mass 46 slidably disposed therein. The compression blade balancing mass 42 of one of the blade drivers is positioned in general axial alignment with the compression blade 36 of the other blade driver. The combustion blade balancing mass 46 of one of the blade drivers is positioned in general axial alignment with the combustion blade 38 of the other blade driver. This symmetrically aligned type structure is readily apparent in FIGS. 4, 8 and 9 and serves to dynamically balance the assembly of the shaft 14 and the planar blade drivers 18, thereby reducing or eliminating moment forces about an axis directed medially between the blade drivers and orthogonally relative to a longitudinal axis of the shaft 14. If additionally needed, static balancing of the assembly can also be provided medially in between the blade drivers 18 without affecting the dynamic balance of the assembly provided by the balancing masses 42 and 46.

Figure 3:
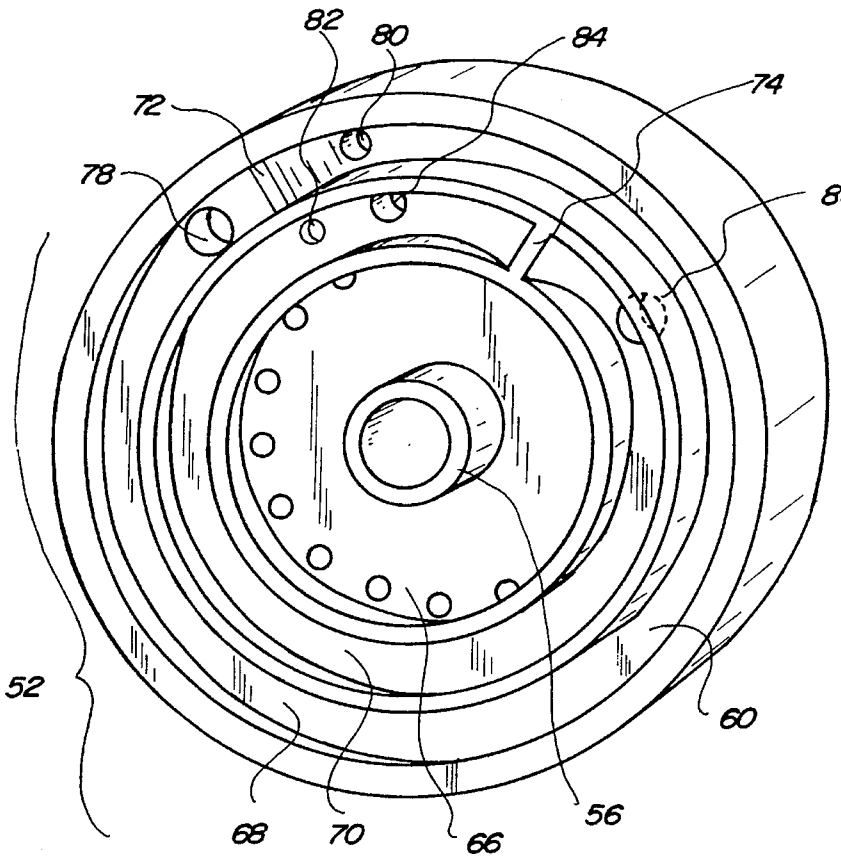
FIG. 3 is a perspective view of an outer section of the casing of the present invention.
Figure 8:
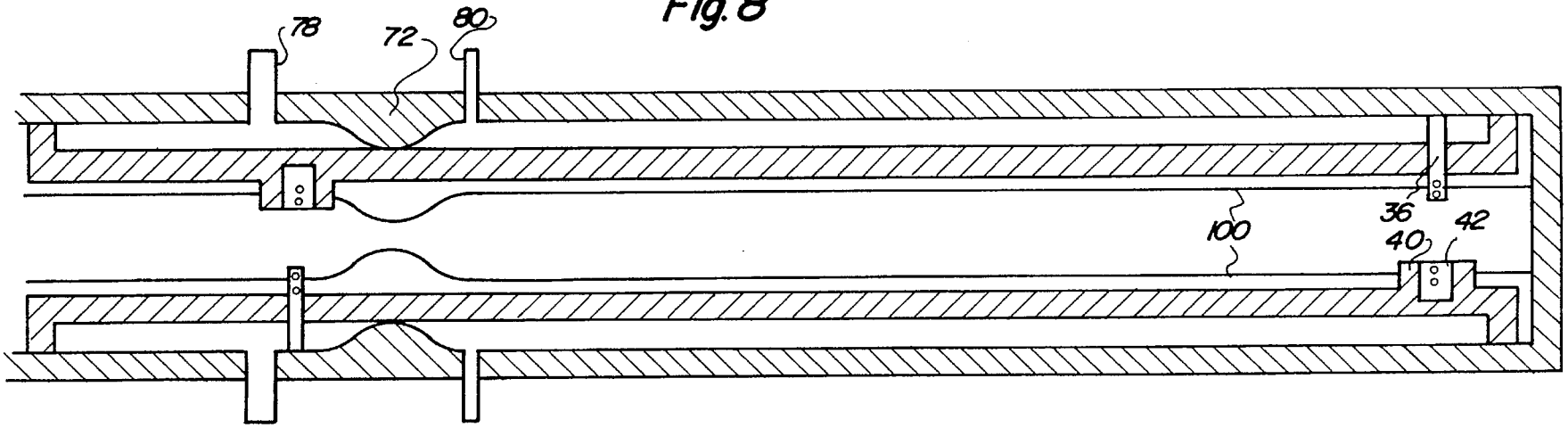
FIG. 8 is a functional representation of the compression chambers of the present invention depicted in an unwrapped cross-sectional configuration.
Figure 9:
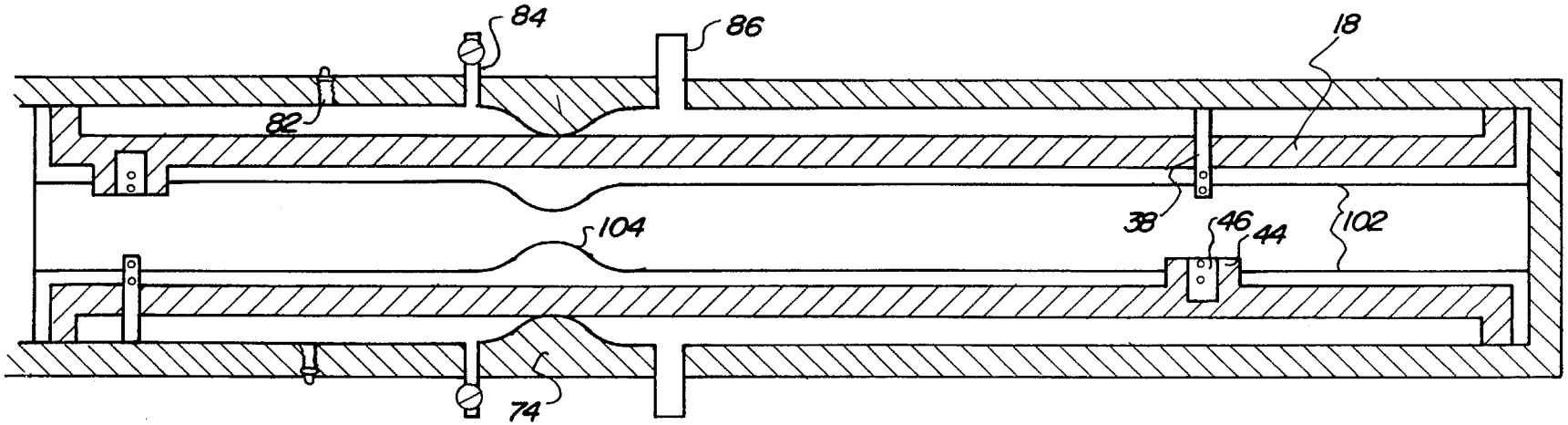
FIG. 9 is a functional representation of the combustion chambers of the present invention depicted in an unwrapped cross-sectional configuration.

The present invention also includes a generally tubular rigid casing 50. The casing 50 generally encompasses the blade driver mechanism 12 such that the shaft 14 is projected outwards therefrom. The casing includes a pair of outer casing sections 52 with a mid-casing section 54 therebetween. The outer casing sections are secured to the mid-casing section with bolts 55. As best illustrated in FIG. 3, each outer casing section includes a tubular bearing housing 56 disposed about the shaft 14 of the driver mechanism. The bearing housing 56 allows rotation of the shaft 14 therein. Each outer casing further includes an annular face plate 58 coupled to and extended radially outwards from the bearing housing. The face plate has an inboard surface 60, an outboard surface 62, and three integral concentric side walls 64 projected inwards from the inboard surface 60. The concentric side walls in combination with the face plate create an annular inner air chamber 66, an annular outer compression chamber 68, and an annular intermediate combustion chamber 70 therebetween. Each outer casing section further includes a combustion chamber blocker 74. The combustion chamber blocker 74 has a generally parabolic cross-section as shown in FIG. 9 and is extended radially across the combustion chamber and then secured between the adjacent side walls 66. Each outer casing also includes a compression chamber blocker 72. The compression chamber as shown in FIG. 8 has a generally parabolic cross-section and is extended radially across the compression chamber and then secured between the adjacent side walls 66. In addition, a plurality of circularly positioned air vent holes 76 are disposed through the face plate 58 and placed in communication with the inner air chamber 66.

Each outer casing section has several ports formed therethrough. An air inlet port 78 is disposed through the face plate and placed in communication with the compression chamber 68 on one side of the compression chamber blocker 72. A compressed air outlet port 80 is disposed through the face plate and placed in communication with the compression chamber on another side of the compression chamber blocker. A spark plug port 82 is disposed through the face plate and placed in communication with the combustion chamber 70 on one side of the combustion chamber blocker 74. The spark plug port 82 has a spark plug 83 secured therein. An air-fuel intake port 84 is disposed through the face plate and placed in communication with the combustion chamber 70 between the spark plug port 80 and the combustion chamber blocker 74. The air-inlet port 78 has an air intake regulator 85 secured therein as shown in FIG. 1. Lastly, an exhaust port 86 is disposed through the face plate and placed in communication with the combustion chamber 70 on another side of the combustion chamber blocker 74. By-products of combusted fuel are evacuated through the exhaust port.

Each outer casing section 52 is positioned in facing contact with the outer extent 24 of the outboard surface 22 of one of the blade drivers 18 to thereby seal the respective inner air chamber 66, combustion chamber 70, and compression chamber 68. In addition, securing the outer casing sections to the outer mid-casing section places the corresponding compression blade into the compression chamber 68 and the corresponding combustion blade 38 into the combustion chamber 70 as best illustrated in FIG. 5. The positioning of the outer casing sections 52 in association with the mid-casing section 54 creates a central fillable oil sump 90 for holding oil for lubricating the inner casing components.

Figure 6:
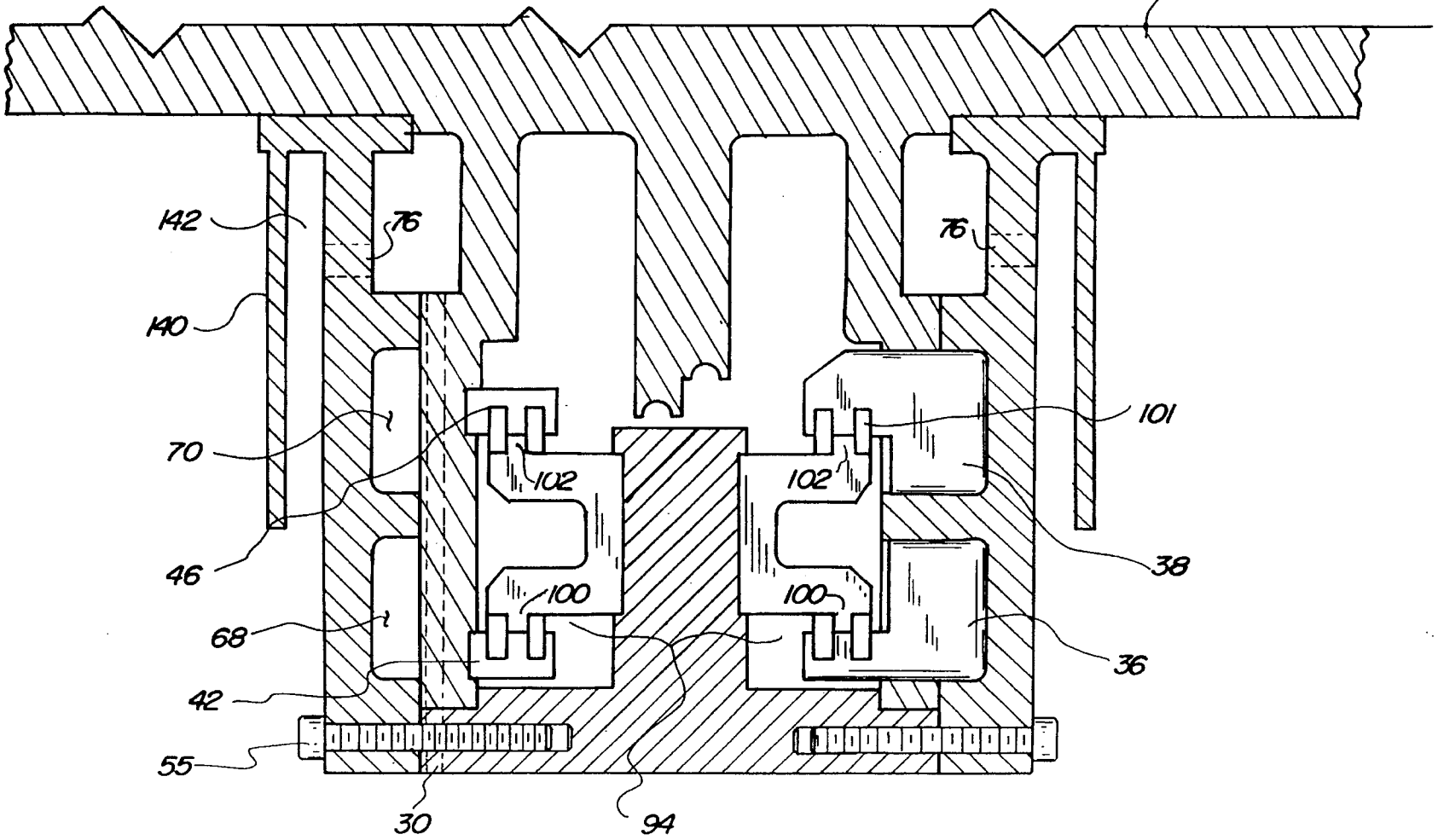
FIG. 6 is a cross-sectional view of a lower portion of the present invention.

The mid-casing section 54 has a generally tubular outer extent 92 and an annular blade guide assembly 94 extended radially inwards as shown in FIG. 6. The blade guide assembly 94 has an upper portion 96 with a pair of push-rod bores 98 disposed therethrough. In addition, the blade guide assembly has an outer radial pair 100 and an inner radial pair 102 of annular blade guides extended therefrom. The outer pair 100 of blade guides is slidably secured to the compression blades 36 of the blade drivers and the compression blade balancing masses 42 of the other blade driver with blade bearings 101. The blade guides 100 control the extension of the compression blades when they are revolved within the compression chambers 68. The inner pair 102 of blade guides is slidably secured to the combustion blades 38 of the blade drivers and the combustion blade balancing masses 46 of the other blade driver with blade bearings 101. The blade guides control extension of the combustion blades when they are revolved within the combustion chamber. Each pair of blade guides includes an undulant portion 104 that allows the blade and associated balancing mass to move freely about the respective blocker as shown in FIG. 9.

Lastly, a rocker arm mechanism 110 is provided as shown in FIG. 5. The rocker arm mechanism is secured to an upper extent of the casing 50. The rocker arm mechanism includes a pair of hollow valve housings 112. Each valve housing is secured to the outboard surface 62 of each face plate of the casing. Each valve housing is also placed in communication with the corresponding compressed air output port 80 and the corresponding air-fuel intake input port 84. Each valve housing includes a fuel inlet port 114 disposed thereon with a fuel inlet nozzle 116 threadedly secured therein. In addition, the valve housing has a valve 118 disposed therein and biased by a spring 120. Each valve has a head portion 122 and a body portion 124. The body portion has a fuel atomizer tip 126 secured thereto. The body portion is positionable for allowing selective communication between the air-fuel intake port 84, the compressed air output port 80, and the fuel inlet port 114. Furthermore, the valve allows alignment of the fuel atomizer 126 with the fuel inlet nozzle 116 for allowing fuel to be disbursed within the combustion chamber in an efficient manner. The rocker arm mechanism also includes a pair of elongated push rods 130. The push rods are separately and slidably disposed within the push rod bores 98 of the casing. The push rods are positioned in contact with the dual cam 16. A pair of rockers 132 are coupled to the upper extent of the casing 50. Each rocker has an arm 134 extended between and in contact with the head portion 122 of one of the valves and an upper end of one of the push rods 130. The location of the dual cam 16 selectively actuates the rockers for allowing the associated ports 80, 84 to be opened and closed by the valve 118. Each arm is supported by a rocker arm support 136. To preclude the rocker arms from being damaged when put in use, a rocker arm casing 137 encompasses the rocker arm mechanism. The casing 137 is held in place with cap screws 138. Another protection mechanism utilized is an engine cooling air guide 140. The engine cooling air guide is secured to each outer casing at a position in front of the air vent holes 76 to thereby define an air split 142.

The automobile piston engine hasn't changed much in the past 100 years or so. Since its invention, the piston engine can now be found in all types of vehicles and in every corner of the globe. Despite its popularity, piston engines, even the best versions, are not very efficient and require numerous moving parts. As a result, the chances for breakdown increase as well as high maintenance costs over the engine's lifetime.

Since the conception of the piston engine, other engines, although not very popular or practical, have come into the scene like the Wankel engine and the electric motor, which is still being developed by car makers to comply with Environmental Protection Agency (EPA) standards. The Wankel engine offers an alternative to the piston engine. The Wankel engine has less moving parts and works in a very circular manner. Despite its advantages, the Wankel engine is not very popular due to excessive leaks and wearing due to its triangular movement. Another alternative is the electric motor. In terms of complying with EPA standards, it is excellent. However, its disadvantages come when range of operation are taken into focus. Even the best electric engines have limited range and application. In addition, the electric engine is not very practical due to considerable plant-control restructuring for providing electrical power for their operation.

The present invention, like the Wankel engine, is a rotary type. Unlike pistons, which move up and down, the present invention moves in a continuous circular manner with virtually no wear within the combustion or compression chambers. As a result, power loss is dramatically reduced and efficiency is improved. In addition, the present invention uses fewer moving parts than the standard piston engine and thus increases its reliability. The present invention also requires no liquid coolant as designed. However, as an option, liquid coolant can be utilized. Another important feature of the present invention is the construction of its combustion and compression chambers 68, 70. This feature minimizes or even eliminates knocking and other problems inherent in a piston engine. The compression ratio is of the present invention is 8:1—much greater than a conventional piston engine of the same weight. With respect to the type of fuel used, the present invention can be modified to utilize gasoline or methanol, but the desired fuel is hydrogen.

The present invention is a circular type engine. It consists of basically four main components that fit together in-line with the shaft axis. FIG. 1 shows the cut away view of the engine. Included are engine shaft 14, two outer casing sections with a mid-casing section therebetween, two valves 118, two blade drivers 18 and four blade guides. The electrical distribution system, which is the same as the conventional type used in a piston engine, is not shown.

FIG. 3 shows a more detailed view of an outer casing section. There are two outer casing sections on this engine—one on the right and one on the left. Each outer chamber casing section consists of a compression chamber 68 and a combustion chamber 70. Each chamber has an incline wall that leads up to a blocker. One blocker 72, 74 in association with a blade can achieve compression and the other block in association with another blade can achieve combustion. Connected to the shaft is the blade driver 18. The blade driver is designed to drive the blade and the balancing mass along a generally circular path. Each blade 36, 38 and the associated balancing mass 42, 46 sit loosely in a slot so that the blade guide can move it from side to side in order to pass by a blocker. Each chamber also has an input and output port. For the compression chamber, an air inlet port 78 and a compressed air output port 80 are provided. This output port is positioned directly above the air-fuel intake 84 of the combustion chamber. Air compression is achieved by first allowing air to enter through the air inlet port. As the compression blade 36 passes the air inlet port and continues revolving, the remaining air in the compression chamber 68 is trapped and compressed. The air will be compressed until the associated valve 118 opens to allow the air to escape through the compressed air output port. The compressed air exiting the compression chamber goes directly into the valve mounted right next to the outer casing. Once the compressed air is within the valve housing, it is mixed with atomized fuel particles from the atomizer 126 and then enters the combustion chamber 70 through the air-fuel intake port of the combustion chamber to be fired by the spark plug 83. The air-fuel mixture entering the combustion chamber enters at high pressure. The valve will allow the air-fuel mixture to enter the combustion chamber only after the combustion blade passes over the blocker 74 and air-fuel inlet port. The blades of the engine will not hit the blocker due to the unique blade guide contour 104 that is sandwiched between each blocker. The contour of the blade guide is the same as the contour of the blocker. Once the air-fuel mixture is inside the combustion chamber and the compression blade passes its blocker and air-fuel intake hole, the valve is then closed, the spark plug residing in the spark plug port fires, and combustion takes place.

Figure 2:
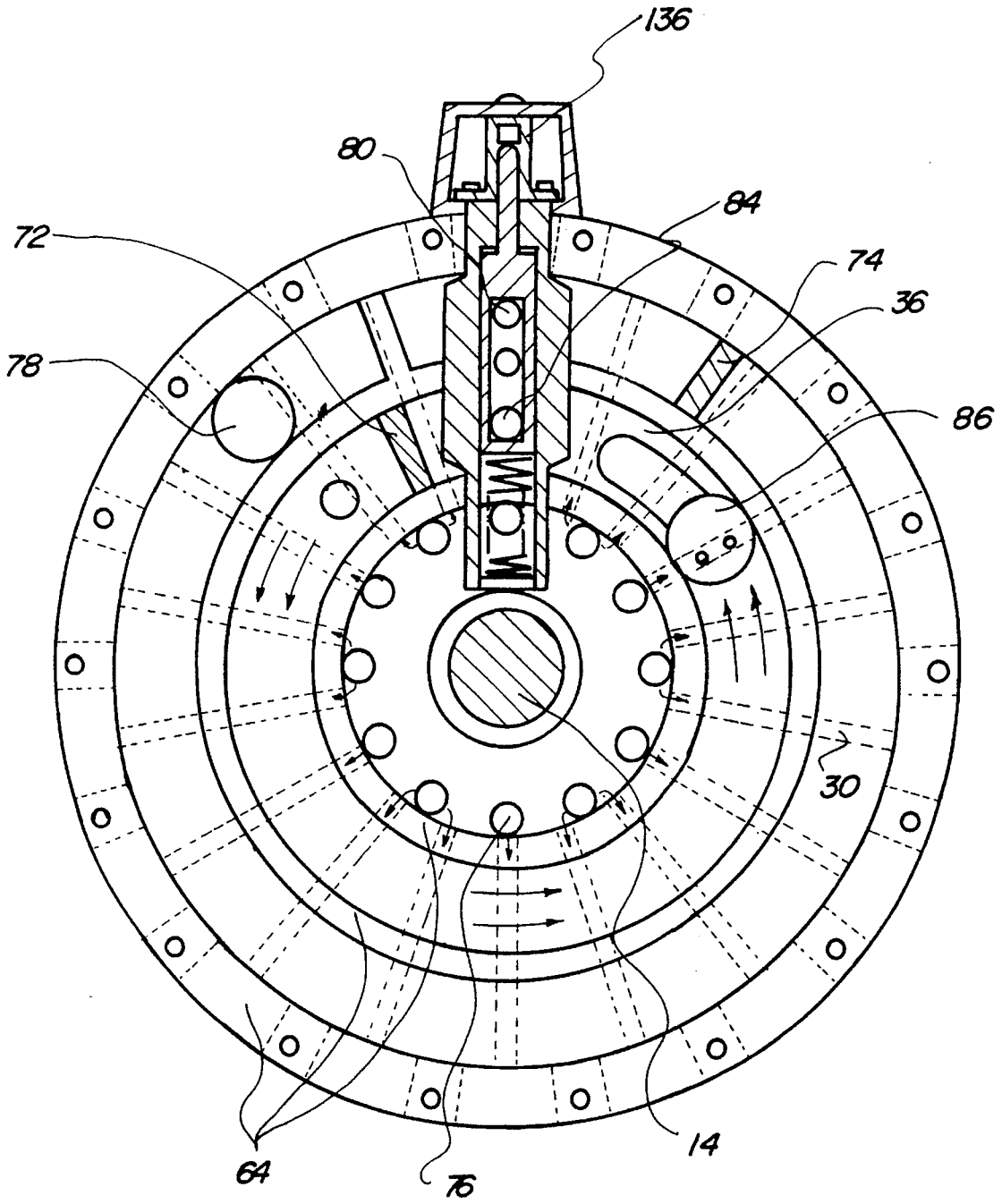
FIG. 2 is a cross-sectional view of the present invention taken along the line 2—2 of FIG. 1.

There are two blade drivers in this. If the shaft 14 of the engine is spun so that the compression blade in the left side compression chamber sits at 90 degrees, then this blade is positioned at the top of the engine with respect to the coordinate system defined in FIGS. 7A–7D. As shown in FIG. 4, the compression blade 36 associated with one blade driver is 40 degrees offset from the adjacent combustion blade, 38. Associated with each blade is a balancing mass 42, 46. The right compression blade and its balancing mass are 180 degrees offset from the left compression blade. The right combustion blade and its balancing mass are 180 degrees offset from the left combustion blade. The function of the two compression blades is to compress gas. The function of the two combustion blades is to capture the exploding or expanding gases. As best illustrated in FIGS. 8 and 9, the blades moves in and out of their associated chambers as dictated by their blade guides. The directed motion also holds true for the balancing masses associated with the blades. The purpose of the balancing mass is to balance out any vibrations caused by the blades moving in and out of their respective chambers. The balancing mass itself does not move into any chamber. The blade driver also has holes 30 extruding from its center which allows it to function as an air-cooling centrifugal fan when the engine is rotating as shown in FIG. 2.

The shaft along with the cam 16 and blade drivers are connected together and act as a single piece component. They all rotate at the same time and direction and at the same angular speed. These are the main moving components. As the shaft rotates, the cam will rotate also. Sliding along the cam are the push rods 138. Due to the force of the spring 120 on the valves, the rocker arm reacts to the motion of the push rod thus presses the valve open and closed as shown in FIG. 1. When a valve is opened, compressed air from the compression chamber and fuel from the fuel inlet 114 rush into the combustion chamber. After a few milliseconds, the valve closes and combustion takes place. Since there are two outer casing sections on each side of the engine, the present invention is like two engines in one. This is because each outer chamber casing and its accompanying component parts act like an engine. Combustion within the right and left chamber casings takes place 180 degrees apart. This keeps the engine running smooth and produces a constant torque.

Each blade driver has a compression blade and a combustion blade extended therefrom. The blades moves in and out of the respective chambers through the slot in the blade driver and are guided by the associated blade guide. The blade driver does more than just hold and move the blades and balancing masses. It also provides an enclosure for the chambers so that compression and combustion can take place. Because of the way this engine is designed, combustion and compression take place at virtually the same time with compression starting first.

Figure 7B:
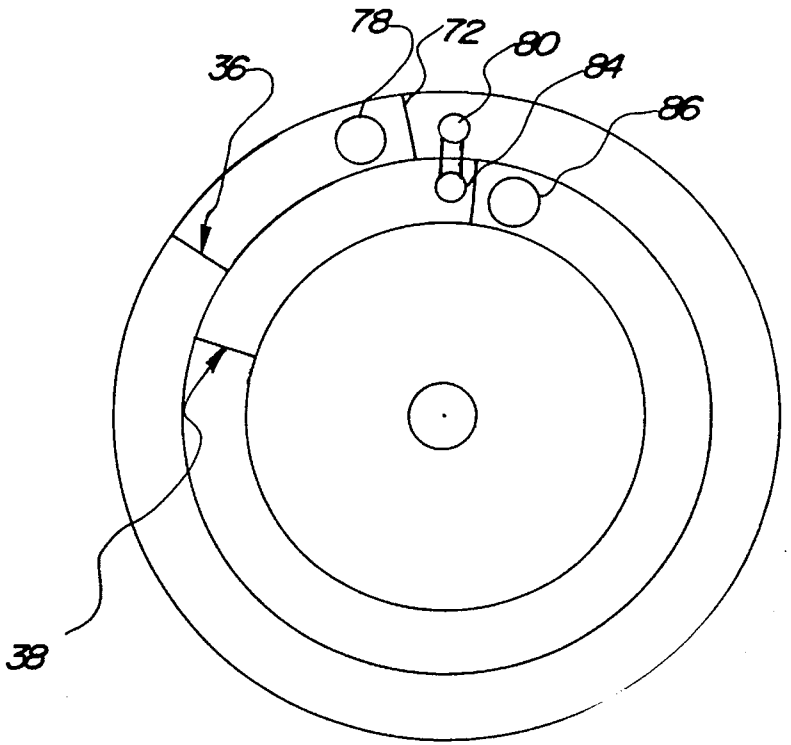
FIG. 7B is a functional representation of the present invention depicted in a compression cycle.
Figure 7A:
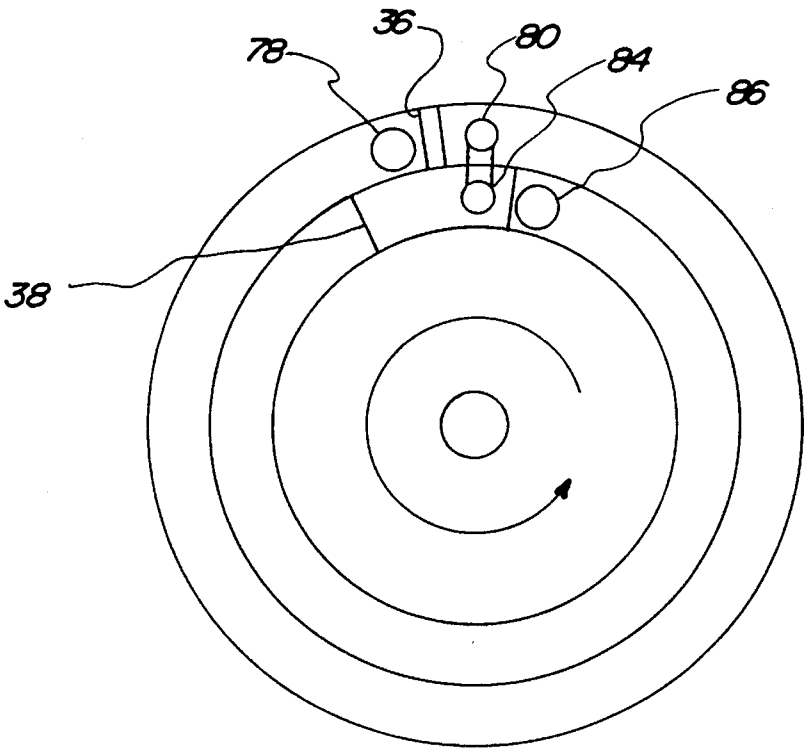
FIG. 7A is a functional representation of the present invention depicted in a neutral position.

FIGS. 7A through 7D depict four phases that the engine goes through. The four phases comprise one engine cycle. FIG. 7A depicts the neutral phase. The neutral phase occurs is when the engine is at rest and nothing has happened as of yet. However, air from the atmosphere is allowed to enter the compression chamber freely. FIG. 7B depicts the engine in the compression phase. Compression, as mentioned earlier, takes place as follows:

a. The compression blade passes its blocker and the valve closes.

b. The air that was already inside the compression chamber is now trapped and starts to compress as the compression blade moves toward the blocker. During the compression phase, all the valves are closed.

c. As the forward side of the blade is doing the compression, the rear side of the blade is sucking air through the air intake hole and into the chamber. The air coming into the compression chamber is regulated by the air intake regulator, thus allowing the control of engine speed.

Figure 7D:
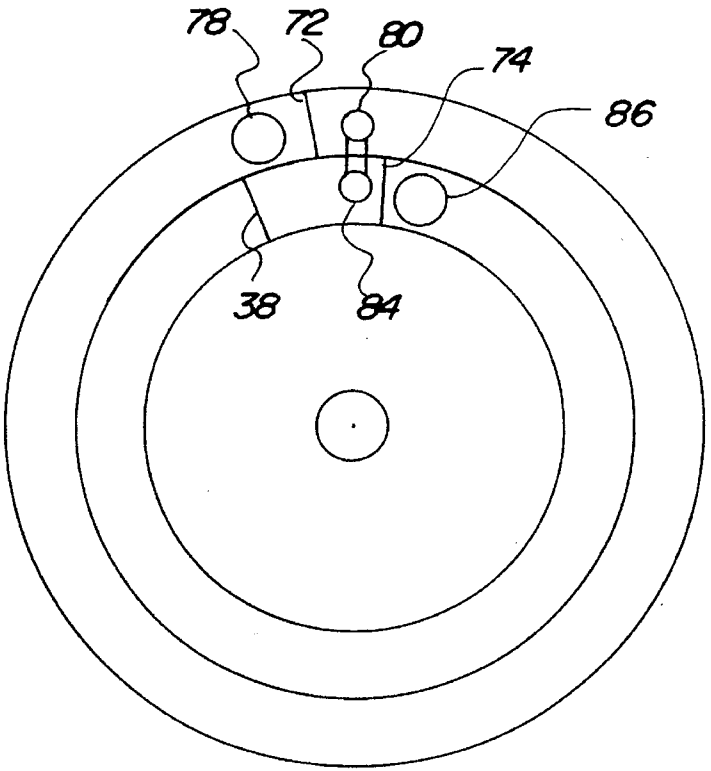
FIG. 7D is a functional representation of the present invention depicted in a combustion cycle.
Figure 7C:
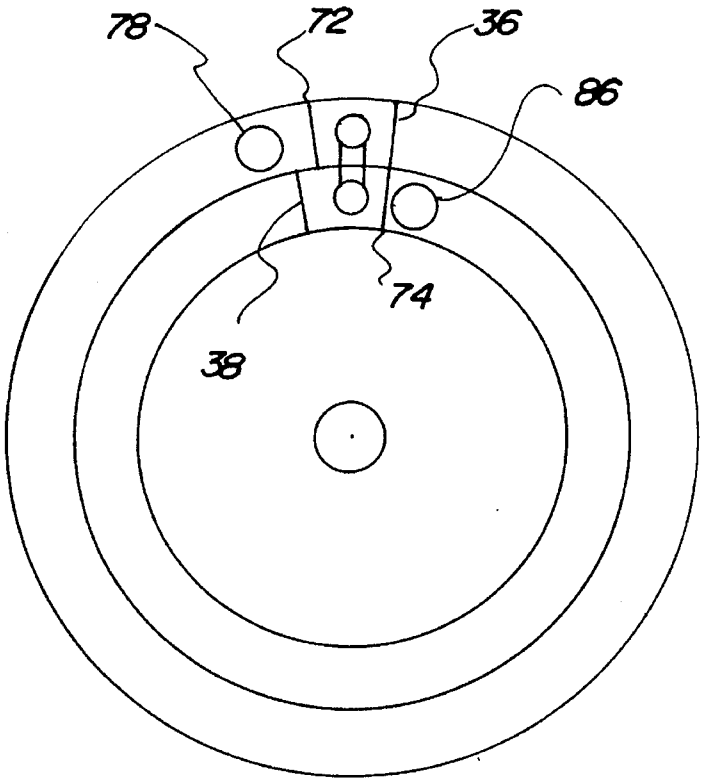
FIG. 7C is a functional representation of the present invention depicted in a position for transferring compressed gas from the compression chamber to the combustion chamber.

Although compression and combustion take place at virtually the same time, the compression cycle is assumed to be at the starting phase of the engine. No combustion has taken place as of yet. FIG. 7C depicts the transfer of the compressed gas from the compression chamber to the combustion chamber. At this time, the valves are opened due to the cams pushing on the push rod and the rocker arm assembly. The compressed gas, before entering the combustion chamber, is first mixed with atomized fuel while still inside the valve chamber. When the compressed air finally reaches the combustion chamber, it is already mixed with fuel. After the air-fuel mixture has entered the combustion chamber, all the valves will be closed. FIG. 7D depicts the combustion phase of the engine. During the combustion phase, the combustion blade and the compression blade will move in the same direction. While the combustion chamber is still expanding, the compression chamber starts to compress air to be used in the next engine cycle. The air that was inside the combustion chamber prior to combustion or last engine phase will leave the engine through the exhaust port. As a result, every revolution this engine makes is also an engine cycle.

FIGS. 8 and 9 depict unwrapped cross-sectional drawings of the compression and combustion chambers and demonstrate how the blade drivers drive the associated blades and balancing mass toward the respective blocker as the engine goes through a cycle. As the blade is about to hit the blocker, it is steered away from the blocker by the blade guide.

To provide greater power output, the present invention can be modified in design to have a bigger radius and utilize four valves, with two valves utilized on one side and the other two values utilized on the other side. Furthermore, if four blades are provided for use within the combustion chambers and four blades are provided for use within the compression chambers and angularly offset at 90 degrees, then 90 degree of two spontaneous ignitions is achieved. The present invention can be modified to function as a hydraulic motor, hydraulic pump, pneumatic motor and pump. The present invention is complicated in function yet it is simple to produce. Most of the major parts are circular and concentric. Circular parts are indeed the simplest to produce.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A rotary internal combustion engine for delivering rotational torquing power for subsequent use comprising, in combination:

a rotatable blade driver mechanism including a cylindrical shaft, a dual cam coupled about the shaft, and a pair of generally annular blade drivers coupled to the shaft on each side of the dual cam, each blade driver having an inboard surface, an outboard surface, a circular inner extent, and an annular outer extent planarly outwardly offset from the inner extent and with the outer extent further including an inboard blade slot disposed therethrough, an outboard blade slot disposed therethrough and angularly offset from the inboard blade slot, and a plurality of elongated tubular circumferentially positioned air vent holes formed radially therethrough between an inner edge extent and an outer edge extent thereof, each blade driver further having an elongated compression blade slidably disposed within the outboard blade slot and an elongated combustion blade slidably disposed within the inboard blade slot, each blade driver additionally having a hollow complimentary compression balancing casing coupled to the inboard surface with an elongated compression blade balancing mass slidably disposed therein and a hollow complimentary combustion balancing casing coupled to the inboard surface with an elongated combustion blade balancing mass slidably disposed therein and with the compression blade balancing mass of one of the blade drivers positioned in general axial alignment with the compression blade of the other blade driver and with the combustion blade balancing mass of one of the blade drivers positioned in general axial alignment with the combustion blade of the other blade driver;

a generally tubular casing generally encompassing the blade driver mechanism such that-the shaft is projected outwards therefrom, the casing including a pair of outer casing sections with a mid-casing section therebetween, each outer casing section including a tubular bearing housing disposed about the shaft of the driver mechanism for allowing its axial rotation, an annular face plate coupled to and extended radially outwards from the bearing housing and with the face plate having an inboard surface, an outboard surface, and three integral concentric side walls projected inwards from the inboard surface thereof to create an annular inner air chamber, an annular outer compression chamber, and an annular intermediate combustion chamber therebetween, each outer casing section further including a combustion chamber blocker extended radially across the combustion chamber and secured between the adjacent side walls, a compression chamber blocker extended radially across the compression chamber and secured between the adjacent side walls, a plurality of circularly positioned air vent holes disposed through the face plate and placed in communication with the inner air chamber, an air inlet port disposed through the face plate and placed in communication with the compression chamber on one side of the compression chamber blocker, a compressed air outlet port disposed through the face plate and placed in communication with the compression chamber on another side of the compression chamber blocker, a spark plug port disposed through the face plate and placed in communication with the combustion chamber on one side of the combustion chamber blocker, an air-fuel intake port disposed through the face plate and placed in communication with the combustion chamber between the spark plug port and the combustion chamber blocker, and an exhaust port disposed through the face plate and placed in communication with the combustion chamber on another side of the combustion chamber blocker, each outer casing section positioned in facing contact with the outer extent of the outboard surface of one of the blade drivers to thereby seal the respective inner air chamber, combustion chamber, and compression chamber and place the corresponding compression blade into the compression chamber and the corresponding combustion blade into the combustion chamber and with the positioning of the outer casing sections in association with the mid-casing section creating a central oil sump, the mid-casing section having a generally tubular outer extent and an annular blade guide assembly extended radially inwards and with the blade guide assembly having an upper portion with a pair of push rod bores disposed therethrough and an outer radial pair and an inner radial pair of annular blade guides extended therefrom and with the outer pair of blade guides slidably secured to the compression blades of the blade drivers and the compression blade balancing masses of the other blade driver for controlling extension of compression blades when being revolved within the compression chambers and with the inner pair of blade guides slidably secured to the combustion blades of the blade drivers and the combustion blade balancing masses of the other blade driver for controlling extension of the combustion blades when being revolved within the combustion chambers; and a rocker arm mechanism secured to an upper extent of the casing, the rocker arm mechanism including a pair of hollow valve housings with each valve housing secured to the outboard surface of each face plate of the casing and further placed in communication with the corresponding compressed air output port and the corresponding air-fuel intake input port, each valve housing further including a fuel inlet disposed thereon and a spring-loaded valve slidably disposed therein and with each valve having a head portion and a body portion with a fuel atomizer tip secured thereto and with the body portion positionable for allowing selective communication between the air-fuel intake port, the compressed air output port, and the fuel inlet port and further allowing alignment of the fuel atomizer with the fuel inlet, the rocker arm mechanism further including a pair of elongated push rods separately slidably disposed within the push rod bores of the casing and positioned in contact with the dual cam, the rocker arm mechanism additionally including a pair of rockers coupled to the upper extent of the casing and with each rocker having an arm extended between and in contact with the head portion of one of the valves and an upper end of one of the push rods and with rotation of the dual cam selectively actuating the rockers for allowing the associated ports to be opened and closed by the valve.

2. A rotary internal combustion engine comprising:

a rotatable blade driver mechanism including a shaft, a cam coupled about the shaft, and a plurality of annular blade drivers coupled to the shaft, and a plurality of extendable compression blades slidably disposed through the blade drivers; and a casing generally encompassing the blade driver mechanism such that the shaft is projected outwards therefrom, the casing including a pair of outer casing sections with a mid-casing section therebetween, each outer casing section including a face plate and a plurality of concentric side walls projected therefrom to create a generally annular compression chamber and a generally annular combustion chamber, each outer casing section further including a combustion chamber blocker extended across the combustion chamber, a compression chamber blocker extended across the compression chamber, an air inlet port disposed through the face plate and placed in communication with the compression chamber on one side of the compression chamber blocker, a compressed air outlet port disposed through the face plate and placed in communication with the compression chamber on another side of the compression chamber blocker, a spark plug port disposed through the face plate and placed in communication with the combustion chamber on one side of the combustion chamber blocker, an air-fuel intake port disposed through the face plate and placed in communication with the combustion chamber between the spark plug port and the combustion chamber blocker, and an exhaust port disposed through the face plate and placed in communication with the combustion chamber on another side of the combustion chamber blocker, each outer casing section positioned in facing contact with one of the blade drivers to thereby seal the respective combustion chamber and compression chamber and further place the corresponding compression blade into the compression chamber and the corresponding combustion blade into the combustion chamber, the mid-casing section having an annular blade guide assembly extended radially inwards with a plurality of annular blade guides extended therefrom and with the blade guides slidably secured to the compression blades and the combustion blades for controlling their extension within the compression chambers and combustion chambers.

3. The rotary combustion engine as set forth in claim 2 wherein each blade driver includes a plurality of air vent holes formed radially therethrough.

4. The rotary combustion engine as set forth in claim 2 further including balancing mass means coupled thereto for maintaining rotation of each blade driver in a respective common plane.

5. The rotary combustion engine as set forth in claim 2:

wherein the side walls of each outer casing section in association with the blade drivers further define a plurality of air chambers; and wherein each outer casing section has a plurality of air vent holes disposed thereon and with the vent holes placed in communication with the air chambers.

6. The rotary combustion engine as set forth in claim 2 wherein the positioning of the outer casing sections in association with the mid-casing section create a central oil sump.

7. The rotary combustion engine as set forth in claim 2 wherein the blade guide assembly has a plurality of push rod bores disposed therethrough, and further including a rocker arm mechanism secured the casing, the rocker arm mechanism including a plurality of hollow valve housings with each valve housing placed in communication with one of the corresponding compressed air output ports and one of the corresponding air-fuel intake input ports, each valve housing further including a fuel inlet disposed thereon and a spring-loaded valve slidably disposed therein and with each valve positionable for allowing selective communication between the air-fuel intake port, the compressed air output port, and the fuel inlet port, the rocker arm mechanism further including a plurality of push rods slidably disposed within the push rod bores of the casing and positioned in contact with the cam, the rocker arm additionally including a plurality of rockers coupled to the casing and with each rocker having an arm extended between and in contact with one of the valves and one of the push rods and with rotation of the cam selectively actuating the rockers for allowing the associated ports to be opened and closed by the valve.

* * * * *